US010269312B2

(12) United States Patent
Hwang et al.

(10) Patent No.: US 10,269,312 B2
(45) Date of Patent: Apr. 23, 2019

(54) DISPLAY PANEL DRIVING APPARATUS, METHOD OF DRIVING DISPLAY PANEL USING THE SAME, AND DISPLAY APPARATUS HAVING THE SAME

(71) Applicant: SAMSUNG DISPLAY CO., LTD., Yongin-si, Gyeonggi-Do (KR)

(72) Inventors: In-Jae Hwang, Suwon-si (KR); Hyun-Joon Kim, Yongin-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 70 days.

(21) Appl. No.: 15/169,956

(22) Filed: Jun. 1, 2016

(65) Prior Publication Data

US 2016/0358563 A1 Dec. 8, 2016

(30) Foreign Application Priority Data

Jun. 2, 2015 (KR) ..... 10-2015-0078150

(51) Int. Cl.
*G09G 3/36* (2006.01)
*G09G 3/20* (2006.01)

(52) U.S. Cl.
CPC ..... *G09G 3/3607* (2013.01); *G09G 3/3677* (2013.01); *G09G 3/2077* (2013.01); *G09G 3/2081* (2013.01); *G09G 2310/0267* (2013.01); *G09G 2320/02* (2013.01); *G09G 2320/028* (2013.01)

(58) Field of Classification Search
None
See application file for complete search history.

(56) References Cited

U.S. PATENT DOCUMENTS 6,587,084 B1 * 7/2003 Alymov ..... G09G 3/2029 345/37
2002/0000960 A1 * 1/2002 Yoshihara ..... G09G 3/342 345/87
2007/0171163 A1 * 7/2007 Miyata ..... G09G 3/3614 345/87
2013/0314392 A1 11/2013 Kim
(Continued)

FOREIGN PATENT DOCUMENTS

JP 2012-177928 9/2012
KR 1020070024893 3/2007
(Continued)

OTHER PUBLICATIONS

European Search Report dated Jul. 29, 2016 from the European Patent Office in the corresponding European Patent Application No. 16172737.5.

*Primary Examiner* — Duane N Taylor, Jr.
(74) *Attorney, Agent, or Firm* — F. Chau & Associates, LLC

(57) ABSTRACT

A display panel driving apparatus includes a data driving part and a gate driving part. The data driving part is configured to convert image data into a data signal and output the data signal to a data line of a display panel. The gate driving part is configured to output, to a gate line of the display panel, a gate signal having different gate on voltages during a first sub-frame period of a frame period and a second sub-frame period subsequent to the first sub-frame period. Thus, display quality of a display apparatus may be improved.

18 Claims, 9 Drawing Sheets

(56) References Cited

U.S. PATENT DOCUMENTS

| | | | |
|---|---|---|---|
| 2015/0091883 | A1 | 4/2015 | Pyun et al. |
| 2016/0063955 | A1 | 3/2016 | Yamamoto et al. |

FOREIGN PATENT DOCUMENTS

| | | |
|---|---|---|
| KR | 1020080015301 | 2/2008 |
| KR | 1020130134567 | 12/2013 |
| WO | 2014/174889 | 10/2014 |

* cited by examiner

DISPLAY PANEL DRIVING APPARATUS, METHOD OF DRIVING DISPLAY PANEL USING THE SAME, AND DISPLAY APPARATUS HAVING THE SAME

PRIORITY STATEMENT

This application claims priority under 35 U.S.C. § 119 to Korean Patent Application No. 10-2015-0078150, filed on Jun. 2, 2015 in the Korean Intellectual Property Office (KIPO), the contents of which are herein incorporated by reference in their entireties.

TECHNICAL FIELD

Exemplary embodiments of the inventive concept relate to a display panel driving apparatus, a method of driving a display panel using the display panel driving apparatus, and a display apparatus having the display panel driving apparatus. More particularly, exemplary embodiments of the present inventive concept relate to a display panel driving apparatus which drives a display panel of a vertical alignment mode, a method of driving a display panel using the display panel driving apparatus, and a display apparatus having the display panel driving apparatus.

DESCRIPTION OF THE RELATED ART

A liquid crystal display apparatus includes a liquid crystal display panel and a display panel driving apparatus.

The liquid crystal display panel includes a lower substrate, an upper substrate and a liquid crystal layer. The lower substrate includes a thin film transistor and a pixel electrode. The upper substrate includes a common electrode. The liquid crystal layer includes a liquid crystal interposed between the lower substrate and the upper substrate. An arrangement of the liquid crystal is changed by an electric field generated due to a pixel voltage applied to the pixel electrode and a common voltage applied to the common electrode.

When the electric field between the pixel electrode and the common electrode is not applied to the liquid crystal in a liquid crystal display apparatus of a vertical alignment mode, the liquid crystal is arranged in a vertical direction with respect to the lower substrate and the upper substrate. When the electric field between the pixel electrode and the common electrode in a liquid crystal display apparatus of a vertical alignment mode is applied to the liquid crystal, the arrangement of the liquid crystal is changed according to an intensity of the electric field.

SUMMARY

Exemplary embodiments of the present inventive concept provide a display panel driving apparatus capable of improving display quality of a display apparatus.

Exemplary embodiments of the present inventive concept also provide a method of driving a display panel using the above-mentioned display panel driving apparatus.

Exemplary embodiments of the present inventive concept also provide a display apparatus including the above-mentioned display panel driving apparatus.

According to an exemplary embodiment of the present inventive concept, a display panel driving apparatus includes a data driving part and a gate driving part. The data driving part is configured to convert image data into a data signal and output the data signal to a data line of a display panel. The gate driving part is configured to output, to a gate line of the display panel, a gate signal having different gate on voltages during a first sub-frame period of a frame period and a second sub-frame period subsequent to the first sub-frame period.

In an exemplary embodiment, the gate driving part may output a gate signal having a first gate on voltage during the first sub-frame period and output a gate signal having a second gate on voltage lower than the first gate on voltage during the second sub-frame period.

In an exemplary embodiment, a data voltage of the data signal output from the data driving part to the data line during the first sub-frame period and a data voltage of the data signal output from the data driving part to the data line during the second sub-frame period may be the same.

In an exemplary embodiment, each of the data voltage of the data signal output from the data driving part to the data line during the first sub-frame period and the data voltage of the data signal output from the data driving part to the data line during the second sub-frame period may correspond to a white grayscale.

In an exemplary embodiment, a charge voltage charged in a pixel electrode of the display panel during the second sub-frame period may be lower than a charge voltage charged in the pixel electrode during the first sub-frame period.

In an exemplary embodiment, the display panel driving apparatus may further include a voltage supplying part configured to supply the first gate on voltage and the second gate on voltage to the gate driving part.

In an exemplary embodiment, the gate driving part may include a voltage selecting part selecting one of the first gate on voltage and the second gate on voltage in response to a selection signal indicating the first sub-frame period and the second sub-frame period.

In an exemplary embodiment, the frame period may further include a third sub-frame period subsequent to the second sub-frame period, and gate driving part may output a gate signal having a first gate on voltage during the first sub-frame period, output a gate signal having a second gate on voltage lower than the first gate on voltage during the second sub-frame period, and output a gate signal having a third gate on voltage lower than the second gate on voltage during the third sub-frame period.

In an exemplary embodiment, a data voltage of the data signal output from the data driving part to the data line during the first sub-frame period, a data voltage of the data signal output from the data driving part to the data line during the second sub-frame period, and a data voltage of the data signal output from the data driving part to the data line during the third sub-frame period may be the same.

In an exemplary embodiment, each of the data voltage of the data signal output from the data driving part to the data line during the first sub-frame period, the data voltage of the data signal output from the data driving part to the data line during the second sub-frame period, and the data voltage of the data signal output from the data driving part to the data line during the third sub-frame period may correspond to a white grayscale.

In an exemplary embodiment, a charge voltage charged in a pixel electrode of the display panel during the second sub-frame period may be lower than a charge voltage charged in the pixel electrode during the first sub-frame period, and a charge voltage charged in the pixel electrode of the display panel during the third sub-frame period may be lower than the charge voltage charged in the pixel electrode during the second sub-frame period.

In an exemplary embodiment, the display panel driving apparatus may further include a voltage supplying part configured to supply the first gate on voltage, the second gate on voltage and the third gate on voltage to the gate driving part.

In an exemplary embodiment, the gate driving part may include a voltage selecting part selecting one of the first gate on voltage, the second gate on voltage and the third gate on voltage in response to a selection signal indicating the first sub-frame period, the second sub-frame period and the third sub-frame period.

In an exemplary embodiment, the frame period may include N sub-frame periods. The gate driving part may output a gate signal having N different gate on voltages during N sub-frame periods. N is a natural number.

According to an exemplary embodiment of the present inventive concept, a method of driving a display panel includes outputting a data signal to a data line of the display panel during a first sub-frame period of a frame period, outputting a gate signal having a first gate on voltage to a gate line of the display panel during the first sub-frame period. The method of driving a display panel also includes outputting the data signal to the data line during a second sub-frame period subsequent to the first sub-frame period, and outputting a gate signal having a second gate on voltage different from the first gate on voltage to the gate line during the second sub-frame period.

In an exemplary embodiment, the second gate on voltage may be lower than the first gate on voltage, and a charge voltage charged in a pixel electrode of the display panel during the second sub-frame period may be lower than a charge voltage charged in the pixel electrode during the first sub-frame period.

In an exemplary embodiment, the method may further include outputting the data signal to the data line during a third sub-frame period subsequent to the second sub-frame period, and outputting a gate signal having a third gate on voltage different from the first gate on voltage and the second gate on voltage to the gate line during the third sub-frame period.

In an exemplary embodiment, the third gate on voltage may be lower than the second gate on voltage, and a charge voltage charged in the pixel electrode of the display panel during the third sub-frame period is lower than the charge voltage charged in the pixel electrode during the second sub-frame period.

According to an exemplary embodiment of the present inventive concept, a display apparatus includes a display panel and a display panel driving apparatus. The display panel is configured to display an image and includes a gate line and a data line. The display panel driving apparatus includes a data driving part configured to convert image data into a data signal and output the data signal to the data line, and a gate driving part configured to output, to the gate line, a gate signal having different gate on voltages during a first sub-frame period of a frame period and a second sub-frame period subsequent to the first sub-frame period.

In an exemplary embodiment, the frame period may include N sub-frame periods. The gate driving part may output a gate signal having N different gate on voltages during N sub-frame periods. N is a natural number.

In an exemplary embodiment, a display panel driving apparatus includes a data driving part configured to convert image data into a data signal and output the data signal to a data line of a display panel. The display panel driving apparatus also includes a gate driving part configured to output, to a gate line of the display panel, a gate signal including N different gate on voltages during N sub-frame periods of a frame period, wherein N is a natural number.

In an exemplary embodiment, each successive gate on voltage may have a lower voltage than the preceding gate on voltage. In the current exemplary embodiment each of the data voltage of the data signal output from the data driving part to the data line during each of N successive sub-frame period of a frame period corresponds to a white grayscale.

In an exemplary embodiment, each progressive gate on voltage has a higher voltage than the preceding gate on voltage. In the current exemplary embodiment each of the data voltage of the data signal output from the data driving part to the data line during each of N successive sub-frame period of a frame period corresponds to a grayscale adjacent to a white grayscale.

BRIEF DESCRIPTION OF THE DRAWINGS

The above and other features of the present inventive concept will become more apparent by describing in detailed example embodiments thereof with reference to the accompanying drawings, in which.

DETAILED DESCRIPTION OF THE INVENTIVE CONCEPT

Hereinafter, the present inventive concept will be explained in detail with reference to the accompanying drawings.

Figure 1:
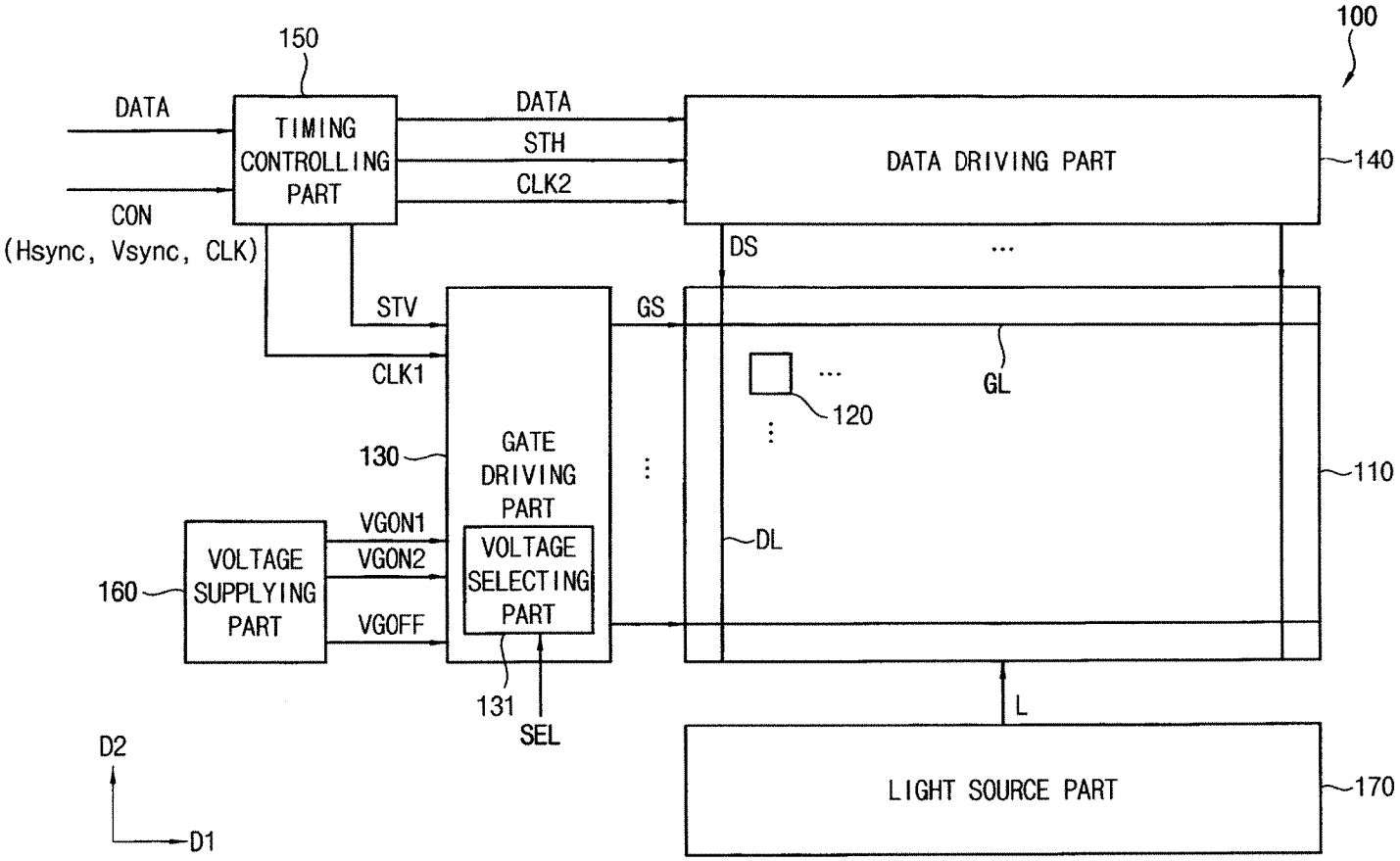
FIG. 1 is a block diagram illustrating a display apparatus according to an exemplary embodiment of the present inventive concept.

FIG. 1 is a block diagram illustrating a display apparatus according to an exemplary embodiment of the present inventive concept.

Referring to FIG. 1, the display apparatus 100 according to the present exemplary embodiment includes a display panel 110, a gate driving part 130, a data driving part 140, a timing controlling part 150, a voltage supplying part 160 and a light source part 170.

The display panel 110 receives a data signal DS based on an image data DATA provided from the timing controlling part 150 to display an image. For example, the display panel 110 may be a liquid crystal display panel. Thus, the display panel 110 may include a lower substrate, an upper substrate and a liquid crystal layer. The lower substrate includes a thin film transistor and a pixel electrode. The upper substrate includes a common electrode. The liquid crystal layer is interposed between the lower substrate and the upper substrate, and includes a liquid crystal. For example, the display panel 110 may be a liquid crystal display panel of a vertical alignment mode, in which the liquid crystal is arranged in a vertical direction with respect to the lower substrate and the upper substrate when an electric field of the pixel electrode and the common electrode is not applied to the liquid crystal.

The display panel 110 includes gate lines GL, data lines DL and a plurality of pixels 120. The gate lines GL extend in a first direction D1 and are arranged in a second direction D2 substantially perpendicular to the first direction D1. The data lines DL extend in the second direction D2 and are arranged in the first direction D1.

Figure 2:
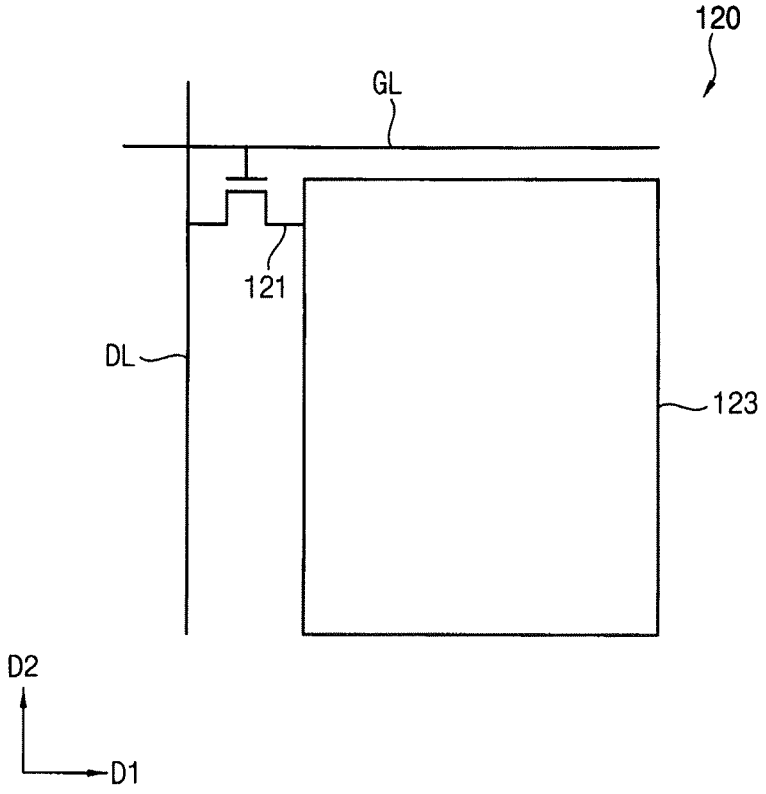
FIG. 2 is a plan view illustrating a pixel of FIG. 1.

FIG. 2 is a plan view illustrating the pixel 120 of FIG. 1.

Referring to FIG. 2, the pixel 120 includes a thin film transistor 121 and a pixel electrode 123. The thin film transistor 121 includes a gate electrode electrically connected to the gate line GL, a source electrode electrically connected to the data line DL, and a drain electrode electrically connected to the pixel electrode 123. The pixel electrode 123 is electrically connected to the drain electrode of the thin film transistor 121. For example, the pixel electrode 123 may be electrically connected to the drain electrode of the thin film transistor 121 through a contact hole.

Referring to FIG. 1 again, the gate driving part 130, the data driving part 140, the timing controlling part 150 and the voltage supplying part 160 may be defined as a display panel driving apparatus driving the display panel 110.

The gate driving part 130 generates a gate signal GS in response to a gate start signal STV and a gate clock signal CLK1 provided from the timing controlling part 150, and outputs the gate signal GS to the gate line GL. The gate driving part 130 may generate the gate signal GS using a first gate on voltage VGON1, a second gate on voltage VGON2 and a gate off voltage VGOFF provided from the voltage supplying part 160.

The gate driving part 130 may output a gate signal GS having the first gate on voltage VGON1 to the gate line GL during a first sub-frame period of a frame period and may output a gate signal GS having the second gate on voltage VGON2 to the gate line GL during a second sub-frame period subsequent to the first sub-frame period. Here, a level of the first gate on voltage VGON1 and a level of the second gate on voltage VGON2 are different. For example, the second gate on voltage VGON2 may be lower than the first gate on voltage VGON1. Alternatively, the second gate on voltage VGON2 may be higher than the first gate on voltage VGON1. Thus, the gate driving part 130 may output a gate signal GS having different gate on voltages during the first sub-frame period and the second sub-frame period of the frame period.

The gate driving part 130 may include a voltage selecting part 131. The voltage selecting part 131 selects one of the first gate on voltage VGON1 and the second gate on voltage VGON2 in response to a selection signal SEL indicating the first sub-frame period and the second sub-frame period. Thus, the gate driving part 130 may output one voltage selected from the first gate on voltage VGON1 and the second gate on voltage VGON2 as the gate signal GS to the gate line GL.

The data driving part 140 converts the image data DATA provided from the timing controlling part 150 into the data signal DS, and outputs the data signal DS to the data line DL in response to a data start signal STH and a data clock signal CLK2 provided from the timing controlling part 150.

The timing controlling part 150 receives the image data DATA and a control signal CON from an outside source. The control signal CON may include a horizontal synchronous signal Hsync, a vertical synchronous signal Vsync and a clock signal CLK. The timing controlling part 150 generates the data start signal STH using the horizontal synchronous signal Hsync and outputs the data start signal STH to the data driving part 140. In addition, the timing controlling part 150 generates the gate start signal STV using the vertical synchronous signal Vsync and outputs the gate start signal STV to the gate driving part 130. In addition, the timing controlling part 150 generates the gate clock signal CLK1 and the data clock signal CLK2 using the clock signal CLK, outputs the gate clock signal CLK1 to the gate driving part 130, and outputs the data clock signal CLK2 to the data driving part 140.

The voltage supplying part 160 outputs the first gate on voltage VGON1, the second gate on voltage VGON2 and the gate off voltage VGOFF to the gate driving part 130.

The light source part 170 provides light L to the display panel 110. For example, the light source part 170 may include a Light Emitting Diode (LED).

Figure 3:
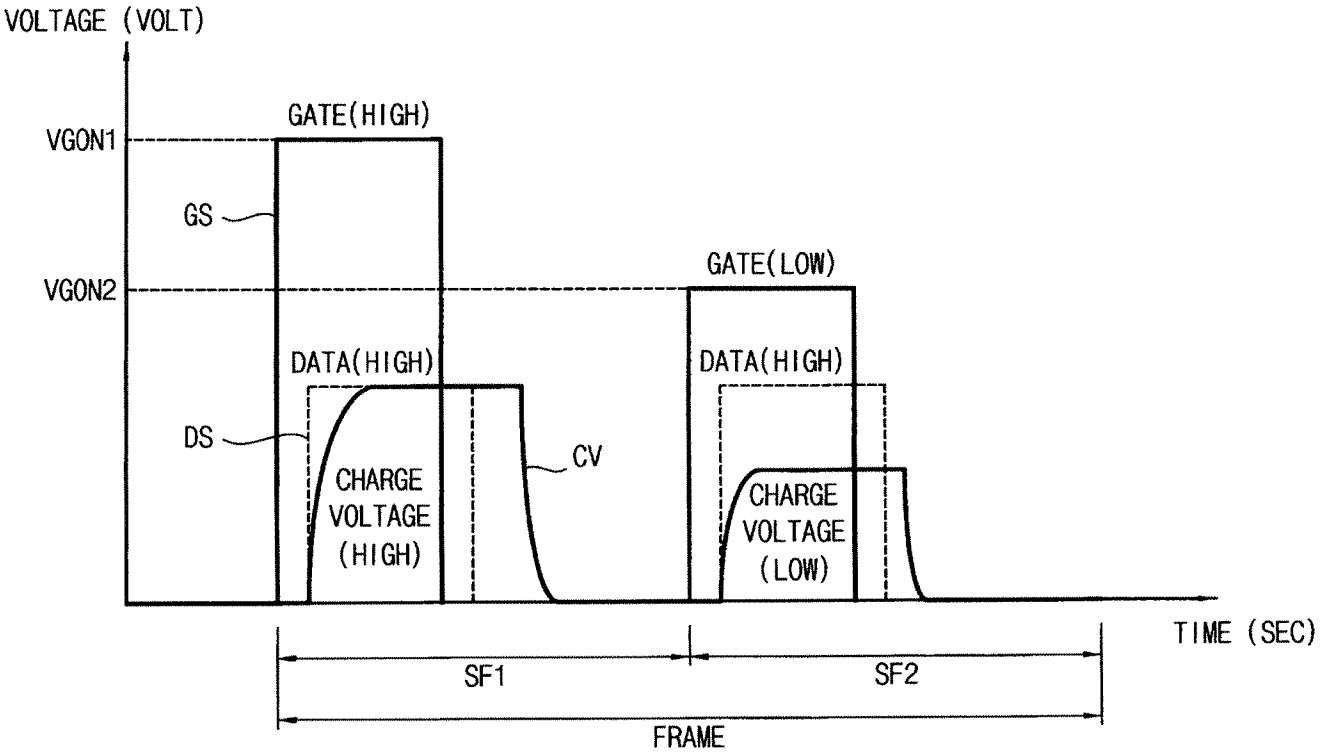
FIG. 3 is a timing diagram illustrating a gate signal of FIG. 1, a data signal of FIG. 1, and a charge voltage charged in the pixel electrode of FIG. 2.
Figure 4:
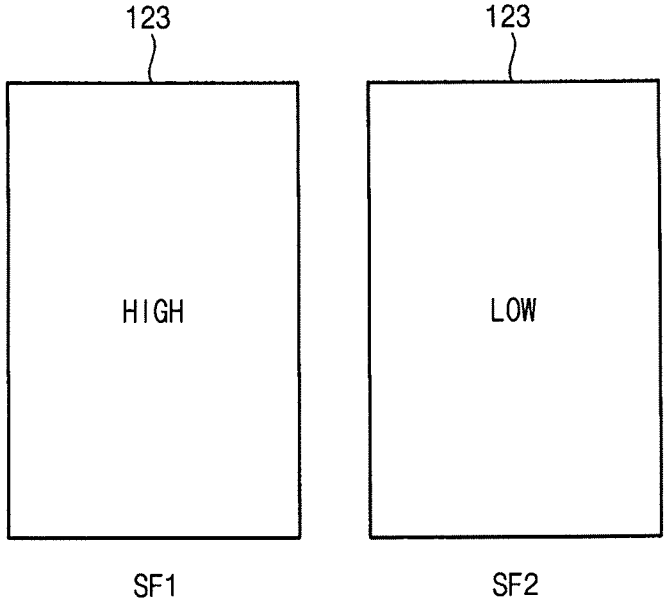
FIG. 4 is a state diagram illustrating the pixel electrode of FIG. 2.

FIG. 3 is a timing diagram illustrating the gate signal GS of FIG. 1, the data signal DS of FIG. 1, and a charge voltage charged in the pixel electrode 123 of FIG. 2. FIG. 4 is a state diagram illustrating the pixel electrode 123 of FIG. 2.

Referring to FIGS. 1 to 4, a frame period FRAME where the image of the image data DATA is displayed on the display panel 110 may include a first sub-frame period SF1 and a second sub-frame period SF2 subsequent to the first sub-frame period SF1.

The gate driving part 130 may output a gate signal GS having the first gate on voltage VGON1 during the first sub-frame period SF1. In addition, the gate driving part 130 may output a gate signal GS having the second gate on voltage VGON2 during the second sub-frame period SF2. Thus, the gate signal GS may have the first gate on voltage VGON1 during the first sub-frame period SF1 and may have the second gate on voltage VGON2 during the second sub-frame period SF2. Here, the first gate on voltage VGON1 may correspond to a high voltage HIGH, and the second gate on voltage VGON2 may correspond to a low voltage LOW. Thus, the second gate on voltage VGON2 may be lower than the first gate on voltage VGON1.

The data driving part 140 outputs the data signal DS during the first sub-frame period SF1 to the data line DL and outputs the data signal during the second sub-frame period SF2 to the data line DL. A data voltage of the data signal DS output from the data driving part 140 to the data line DL during the first sub-frame period SF1 and a data voltage of the data signal DS during the second sub-frame period SF2 are substantially the same. For example, each of the data voltage of the data signal DS output from the data driving part 140 to the data line DL during the first sub-frame period SF1 and the data voltage of the data signal DS during the second sub-frame period SF2 may correspond to a white grayscale. Alternatively, each of the data voltage of the data signal DS output from the data driving part 140 to the data line DL during the first sub-frame period SF1 and the data voltage of the data signal DS during the second sub-frame period SF2 may correspond to a grayscale adjacent to a white grayscale. Thus, each of the data voltage of the data signal DS output from the data driving part 140 to the data line DL during the first sub-frame period SF1 and the data voltage of the data signal DS during the second sub-frame period SF2 may correspond to the high voltage HIGH.

In an embodiment of the current invention the gate signal GS having the first gate on voltage VGON1 is applied to the gate line GL during the first sub-frame period SF1 and the gate signal GS having the second gate on voltage VGON2 lower than the first gate on voltage VGON1 is applied to the gate line GL during the second sub-frame period SF2. Although the data signal DS during the first sub-frame period SF1 and the second sub-frame period SF2 have the substantially the same voltage, the charge voltage CV charged in the pixel electrode 123 of the display panel 110 during the second sub-frame period SF2 is lower than the charge voltage CV charged in the pixel electrode 123 during the first sub-frame period SF1. Thus, the charge voltage CV charged in the pixel electrode 123 during the first sub-frame period SF1 may correspond to the high voltage HIGH according to a first gamma curve, and the charge voltage CV charged in the pixel electrode 123 during the second sub-frame period SF2 may correspond to the low voltage LOW according to a second gamma curve.

Figure 5:
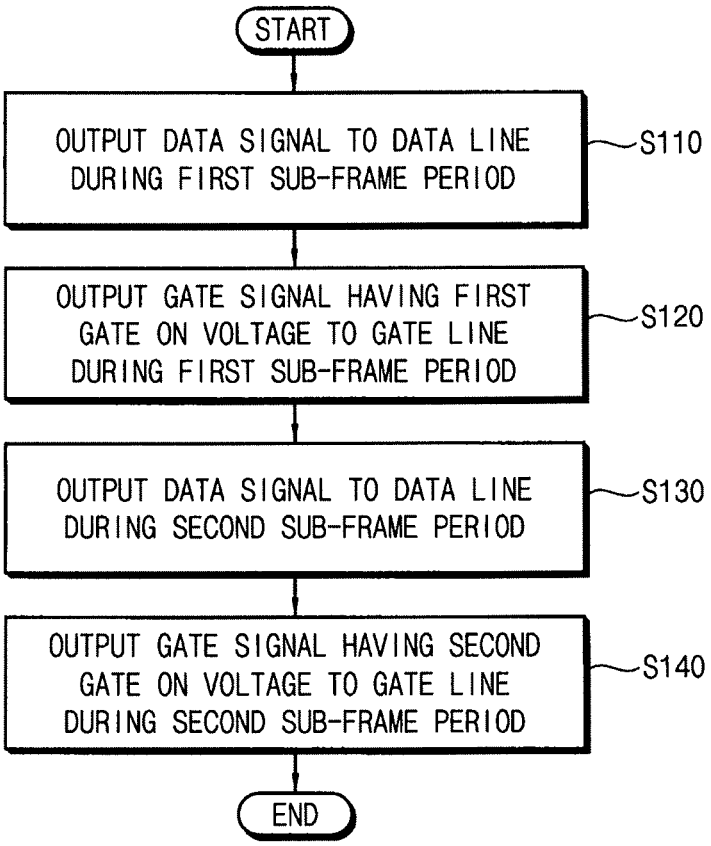
FIG. 5 is a flow chart illustrating a method of driving a display panel performed by a display panel driving apparatus of FIG. 1.

FIG. 5 is a flow chart illustrating a method of driving a display panel performed by the display panel driving apparatus of FIG. 1.

Referring to FIGS. 1 to 5, the data driving part 140 outputs the data signal DS to the data line DL of the display panel 110 during the first sub-frame period SF1 of the frame period FRAME (S110). For example, the data voltage of the data signal DS output from the data driving part 140 to the data line DL during the first sub-frame period SF1 may correspond to a white grayscale. Alternatively, the data voltage of the data signal DS output from the data driving part 140 to the data line DL during the first sub-frame period SF1 may correspond to a grayscale adjacent to a white grayscale.

The gate driving part 130 outputs the gate signal GS having the first gate on voltage VGON1 to the gate line GL of the display panel 110 during the first sub-frame period SF1 (S120). The gate driving part 130 selects the first gate on voltage VGON1 in the first gate on voltage VGON1 and the second gate on voltage VGON2 received from the voltage supplying part 160, in response to the selection signal SEL indicating the first sub-frame period SF1, and outputs the first gate on voltage VGON1 as the gate signal GS. Here, the first gate on voltage VGON1 may correspond to the high voltage HIGH.

The data driving part 140 outputs the data signal DS to the data line DL of the display panel 110 during the second sub-frame period SF2 subsequent to the first sub-frame period SF1 in the frame period FRAME (S130). The data voltage of the data signal DS during the second sub-frame period SF2 is substantially identical to the data voltage of the data signal DS during the first sub-frame period SF1. The data voltage of the data signal DS during the second sub-frame period SF2 may correspond to a white grayscale. Alternatively, the data voltage of the data signal DS output from the data driving part 140 to the data line DL during the second sub-frame period SF2 may correspond to a grayscale adjacent to a white grayscale.

The gate driving part 130 outputs the gate signal GS having the second gate on voltage VGON2 to the gate line GL of the display panel 110 during the second sub-frame period SF2 (S140). The gate driving part 130 selects the second gate on voltage VGON2 and the second gate on voltage VGON2 is received from the voltage supplying part 160, in response to the selection signal SEL indicating the second sub-frame period SF2. The gate driving part 130 outputs the second gate on voltage VGON2 as the gate signal GS. Here, the second gate on voltage VGON2 may correspond to the low voltage LOW. Thus, the second gate on voltage VGON2 may be lower than the first gate on voltage VGON1.

The charge voltage CV charged in the pixel electrode 123 of the display panel 110 during the second sub-frame period SF2 is lower than the charge voltage CV charged in the pixel electrode 123 during the first sub-frame period SF1. This occurs even though the gate signal GS having the first gate on voltage VGON1 is applied to the gate line GL during the first sub-frame period SF1 and the gate signal GS having the second gate on voltage VGON2 lower than the first gate on voltage VGON1 is applied to the gate line GL during the second sub-frame period SF2. Thus, the charge voltage CV charged in the pixel electrode 123 during the first sub-frame period SF1 may correspond to the high voltage HIGH according to the first gamma curve, and the charge voltage CV charged in the pixel electrode 123 during the second sub-frame period SF2 may correspond to the low voltage LOW according to the second gamma curve.

According to the present exemplary embodiment, the charge voltage CV corresponding to the high voltage HIGH is charged in the pixel electrode 123 during the first sub-frame period SF1 and the charge voltage CV corresponding to the low voltage LOW is charged in the pixel electrode 123 during the second sub-frame period SF2. Accordingly, in the present exemplary embodiment the viewing angle of the display apparatus 100 may be increased compared to a case in which only a voltage corresponding to the high voltage HIGH is charged in the pixel electrode 123. Thus, the quality of the display apparatus 100 may be improved.

Figure 6:
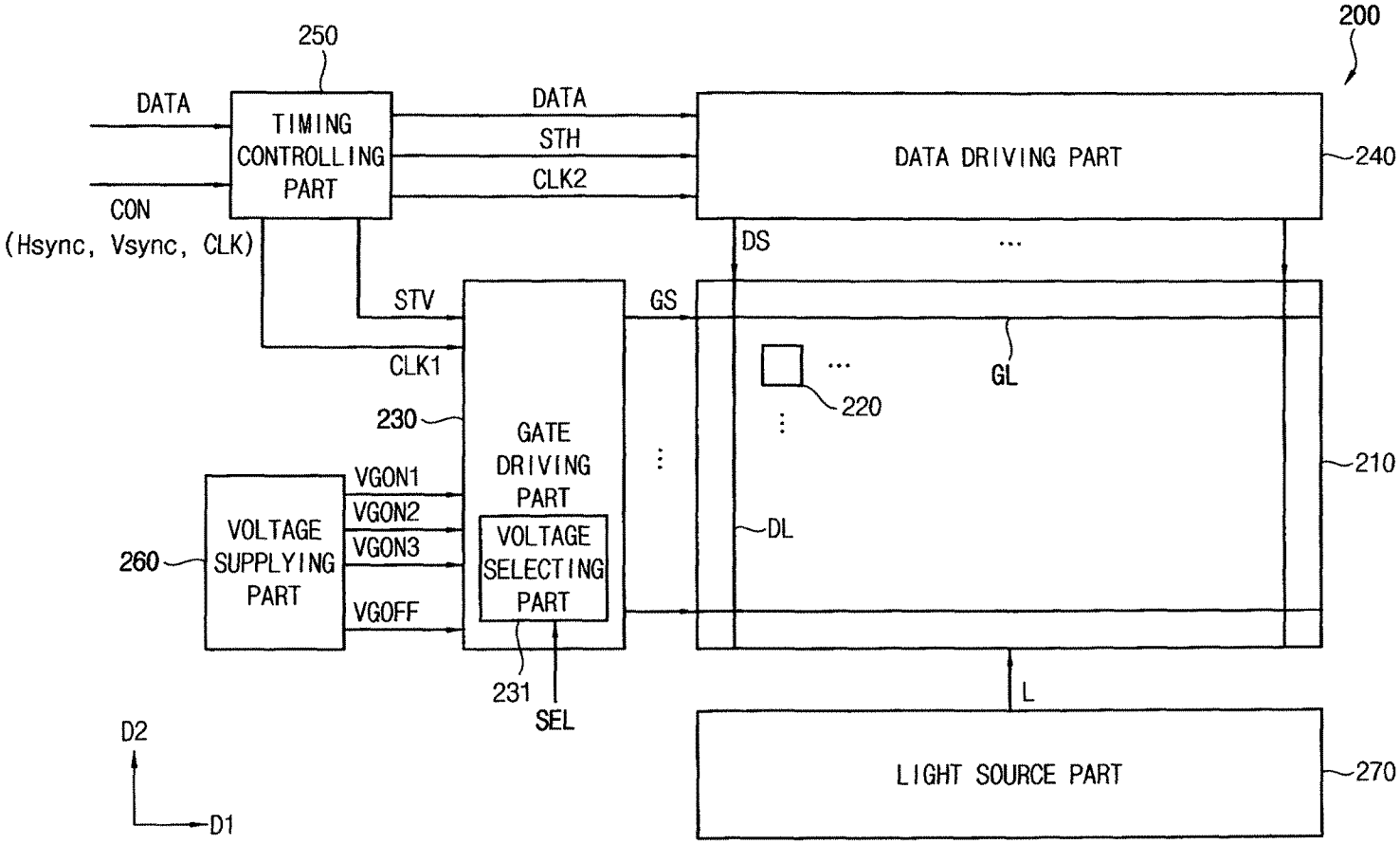
FIG. 6 is a block diagram illustrating a display apparatus according to an exemplary embodiment of the present inventive concept.

FIG. 6 is a block diagram illustrating a display apparatus according to an exemplary embodiment of the present inventive concept.

Referring to FIG. 6, the display apparatus 200 according to the present exemplary embodiment includes a display panel 210, a gate driving part 230, a data driving part 240, a timing controlling part 250, a voltage supplying part 260 and a light source part 270.

The display panel 210 receives a data signal DS based on an image data DATA provided from the timing controlling part 250 to display an image. For example, the display panel 210 may be a liquid crystal display panel. Thus, the display panel 210 may include a lower substrate, an upper substrate and a liquid crystal layer. The lower substrate includes a thin film transistor and a pixel electrode. The upper substrate includes a common electrode. The liquid crystal layer is interposed between the lower substrate and the upper substrate, and includes a liquid crystal. For example, the display panel 210 may be a liquid crystal display panel of a vertical alignment mode, in which the liquid crystal is arranged in a vertical direction with respect to the lower and upper substrates when there is no electric field applied to the pixel electrode and the common electrode.

The display panel 210 includes gate lines GL, data lines DL and a plurality of pixels 220. The gate lines GL extend in a first direction D1 and are arranged in a second direction D2 substantially perpendicular to the first direction D1. The data lines DL extend in the second direction D2 and are arranged in the first direction D1.

The pixel 220 is substantially the same as the pixel 120 of FIG. 2. Thus, the pixel 220 includes the thin film transistor 121 and the pixel electrode 123. The thin film transistor 121 includes the gate electrode electrically connected to the gate line GL, the source electrode is electrically connected to the data line DL, and the drain electrode is electrically connected to the pixel electrode 123. The pixel electrode 123 is electrically connected to the drain electrode of the thin film transistor 121. For example, the pixel electrode 123 may be electrically connected to the drain electrode of the thin film transistor 121 through a contact hole.

Referring to FIG. 6 again, the gate driving part 230, the data driving part 240, the timing controlling part 250 and the voltage supplying part 260 may be defined as a display panel driving apparatus driving the display panel 210.

The gate driving part 230 generates a gate signal GS in response to a gate start signal STV and a gate clock signal CLK1 provided from the timing controlling part 250, and outputs the gate signal GS to the gate line GL. The gate driving part 230 may generate the gate signal GS using a first gate on voltage VGON1, a second gate on voltage VGON2, a third gate on voltage VGON3 and a gate off voltage VGOFF provided from the voltage supplying part 260.

The gate driving part 230 may output a gate signal GS having the first gate on voltage VGON1 to the gate line GL during a first sub-frame period of a frame period. The gate driving part 230 may output a gate signal GS having the second gate on voltage VGON2 to the gate line GL during a second sub-frame period subsequent to the first sub-frame period. Also, the gate driving part 230 may output a gate signal GS having the third gate on voltage VGON3 to the gate line GL during a third sub-frame period subsequent to the second sub-frame period. Here, a level of the first gate on voltage VGON1, a level of the second gate on voltage VGON2 and a level of the third gate on voltage VGON3 are different. For example, the second gate on voltage VGON2 may be lower than the first gate on voltage VGON1, and the third gate on voltage VGON3 may be lower than the second gate on voltage VGON2. Alternatively, the second gate on voltage VGON2 may be higher than the first gate on voltage VGON1, and the third gate on voltage VGON3 may be higher than the second gate on voltage VGON2. Thus, the gate driving part 230 may output the gate signal GS having different gate on voltages during the first sub-frame period, the second sub-frame period and the third sub-frame period in the frame period.

The gate driving part 230 may include a voltage selecting part 231. The voltage selecting part 231 selects one among the first gate on voltage VGON1, the second gate on voltage VGON2 and the third gate on voltage VGON3 in response to a selection signal SEL indicating the first sub-frame period, the second sub-frame period and the third sub-frame period. Thus, the gate driving part 230 may output one selected voltage among the first gate on voltage VGON1, the second gate on voltage VGON2 and the third gate on voltage VGON3 as the gate driving part 230 outputs the gate signal GS to the gate line GL.

The data driving part 240 converts the image data DATA provided from the timing controlling part 250 into the data signal DS, and outputs the data signal DS to the data line DL in response to a data start signal STH and a data clock signal CLK2 provided from the timing controlling part 250.

The timing controlling part 250 receives the image data DATA and a control signal CON from an outside source. The control signal CON may include a horizontal synchronous signal Hsync, a vertical synchronous signal Vsync and a clock signal CLK. The timing controlling part 250 generates the data start signal STH using the horizontal synchronous signal Hsync and outputs the data start signal STH to the data driving part 240. In addition, the timing controlling part 250 generates the gate start signal STV using the vertical synchronous signal Vsync and outputs the gate start signal STV to the gate driving part 230. In addition, the timing controlling part 250 generates the gate clock signal CLK1 and the data clock signal CLK2 using the clock signal CLK, outputs the gate clock signal CLK1 to the gate driving part 230, and outputs the data clock signal CLK2 to the data driving part 240.

The voltage supplying part 260 outputs the first gate on voltage VGON1, the second gate on voltage VGON2, the third gate on voltage VGON3 and the gate off voltage VGOFF to the gate driving part 230.

The light source part 270 provides light L to the display panel 210. For example, the light source part 270 may include a Light Emitting Diode (LED).

Figure 7:
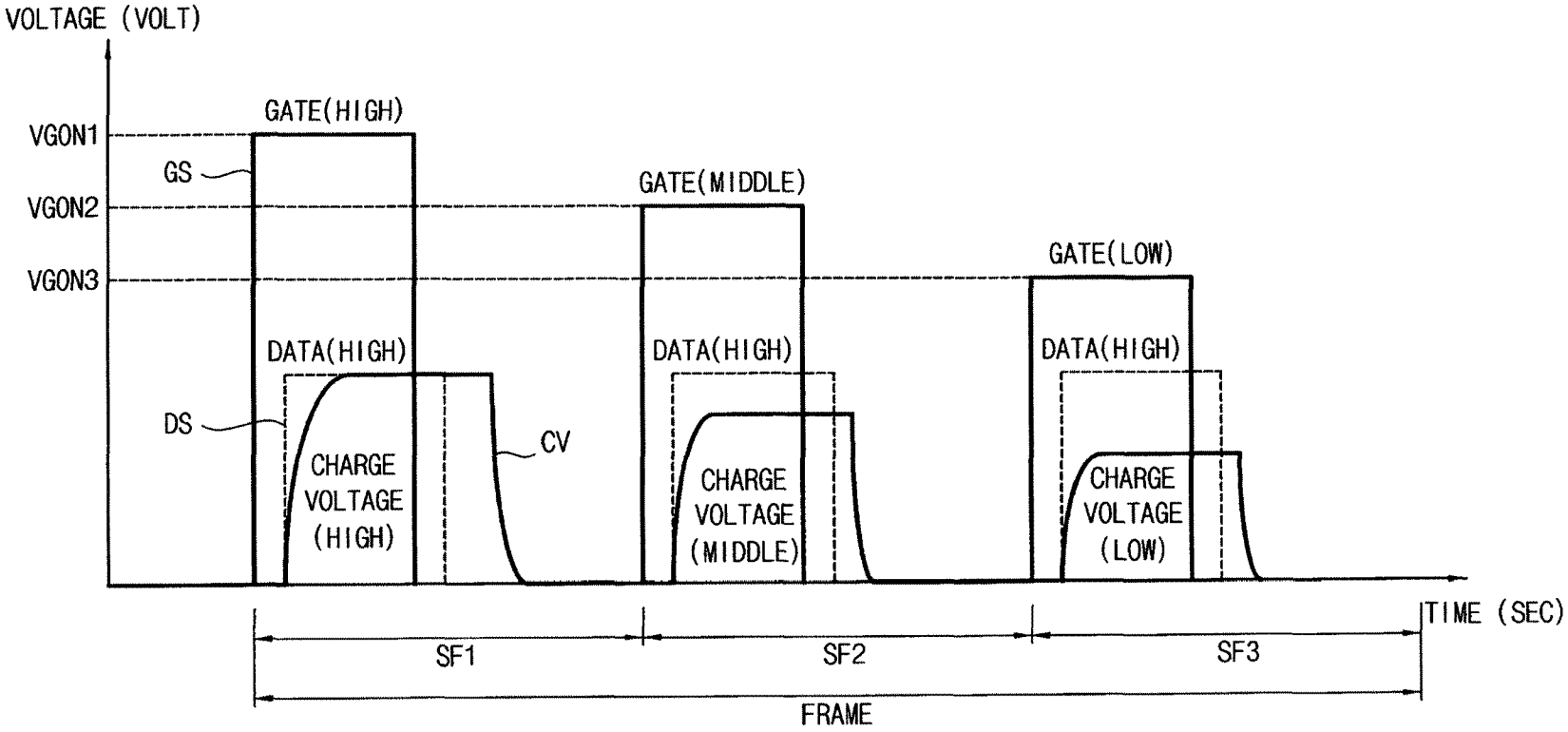
FIG. 7 is a timing diagram illustrating a gate signal of FIG. 6, a data signal of FIG. 6, and a charge voltage charged in the pixel electrode of FIG. 2.
Figure 8:
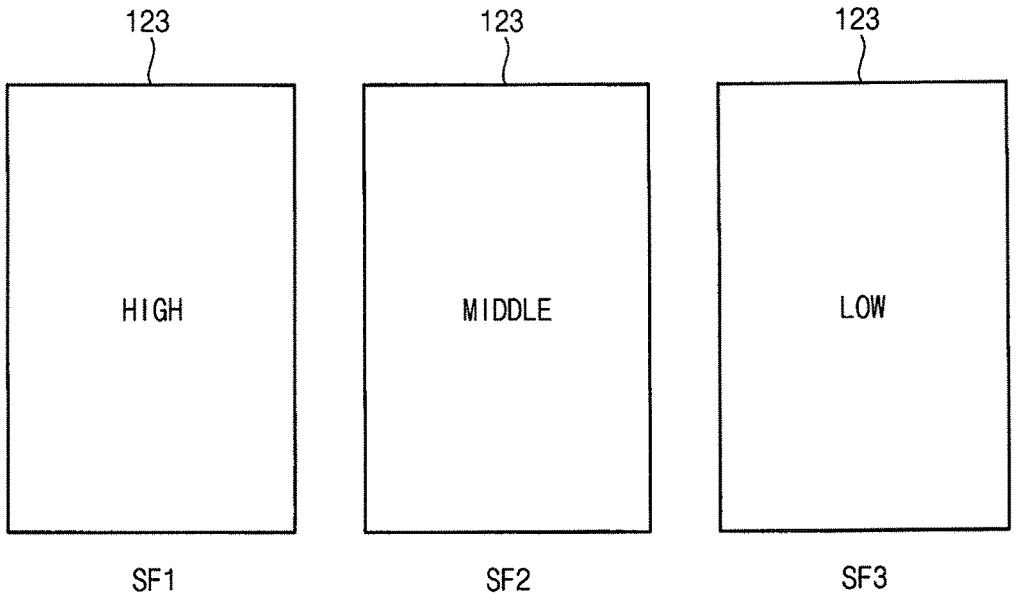
FIG. 8 is a state diagram illustrating the pixel electrode of FIG. 2.

FIG. 7 is a timing diagram illustrating the gate signal GS of FIG. 6, the data signal DS of FIG. 6, and a charge voltage charged in the pixel electrode 123 of FIG. 2. FIG. 8 is a state diagram illustrating the pixel electrode 123 of FIG. 2.

Referring to FIGS. 2 and 6 to 8, a frame period FRAME where the image of the image data DATA is displayed on the display panel 210 may include a first sub-frame period SF1, a second sub-frame period SF2 subsequent to the first sub-frame period SF1, and a third sub-frame period SF3 subsequent to the second sub-frame period SF2.

The gate driving part 230 may output a gate signal GS having the first gate on voltage VGON1 during the first sub-frame period SF1. In addition, the gate driving part 230 may output a gate signal GS having the second gate on voltage VGON2 during the second sub-frame period SF2. In addition, the gate driving part 230 may output a gate signal GS having the third gate on voltage VGON3 during the third sub-frame period SF3. Thus, the gate signal GS may have the first gate on voltage VGON1 during the first sub-frame period SF1. The gate signal GS may have the second gate on voltage VGON2 during the second sub-frame period SF2. The gate signal GS may also have the third gate on voltage VGON3 during the third sub-frame period SF3. Here, the first gate on voltage VGON1 may correspond to a high voltage HIGH, the second gate on voltage VGON2 may correspond to a middle voltage MIDDLE, and the third gate on voltage VGON3 may correspond to a low voltage LOW. Thus, the second gate on voltage VGON2 may be lower than the first gate on voltage VGON1, and the third gate on voltage VGON3 may be lower than the second gate on voltage VGON2.

The data driving part 240 outputs the data signal DS during the first sub-frame period SF1, outputs the data signal during the second sub-frame period SF2, and outputs the data signal during the third sub-frame period SF3. A data voltage of the data signal DS output from the data driving part 240 to the data line DL during the first sub-frame period SF1, a data voltage of the data signal DS during the second sub-frame period SF2, and a data voltage of the data signal DS during the third sub-frame period SF3 are substantially the same. For example, each of the data voltage of the data signal DS output from the data driving part 240 to the data line DL during the first sub-frame period SF1, the data voltage of the data signal DS during the second sub-frame period SF2, and the data voltage of the data signal DS during the third sub-frame period SF3 may correspond to a white grayscale. Alternatively, each of the data voltage of the data signal DS output from the data driving part 240 to the data line DL during the first sub-frame period SF1, the data voltage of the data signal DS during the second sub-frame period SF2, and the data voltage of the data signal DS during the third sub-frame period SF3 may correspond to a gray-scale adjacent to a white grayscale. Thus, each of the data voltage of the data signal DS output from the data driving part 240 to the data line DL during the first sub-frame period SF1, the data voltage of the data signal DS during the second sub-frame period SF2, and the data voltage of the data signal DS during the third sub-frame period SF3 may correspond to the high voltage HIGH.

In an exemplary embodiment the gate signal GS having the first gate on voltage VGON1 is applied to the gate line GL during the first sub-frame period SF1. The gate signal GS having the second gate on voltage VGON2 lower than the first gate on voltage VGON1 is applied to the gate line GL during the second sub-frame period SF2. The gate signal GS having the third gate on voltage VGON3 lower than the second gate on voltage VGON2 is applied to the gate line GL during the third sub-frame period SF3. In the current exemplary embodiment the data signal DS having substantially the same data voltage is applied to the data line DL during the first sub-frame period SF1, the second sub-frame period SF2 and the third sub-frame period SF3. The charge voltage CV charged in the pixel electrode 123 of the display panel 210 during the third sub-frame period SF3 is lower than the charge voltage CV charged in the pixel electrode 123 during the second sub-frame period SF2. The charge voltage CV charged in the pixel electrode 123 during the second sub-frame period SF2 is lower than the charge voltage CV charged in the pixel electrode 123 during the first sub-frame period SF1. The charge voltage CV charged in the pixel electrode 123 during the first sub-frame period SF1 may correspond to the high voltage HIGH according to a first gamma curve. The charge voltage CV charged in the pixel electrode 123 during the second sub-frame period SF2 may correspond to the middle voltage MIDDLE according to a second gamma curve. The charge voltage CV charged in the pixel electrode 123 during the third sub-frame period SF3 may correspond to the low voltage LOW according to a third gamma curve.

Figure 9:
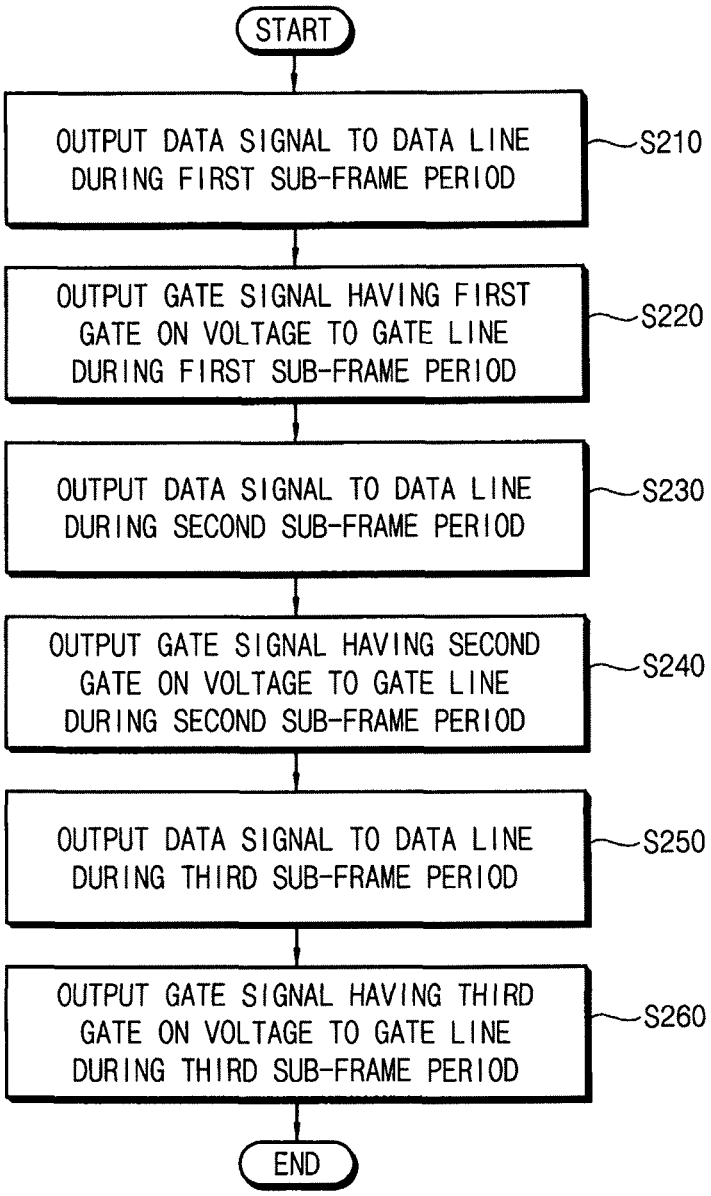
FIG. 9 is a flow chart illustrating a method of driving a display panel performed by a display panel driving apparatus of FIG. 6.

FIG. 9 is a flow chart illustrating a method of driving a display panel performed by the display panel driving apparatus of FIG. 6.

Referring to FIGS. 2 and 6 to 9, the data driving part 240 outputs the data signal DS to the data line DL of the display panel 210 during the first sub-frame period SF1 of the frame period FRAME (S210). For example, the data voltage of the data signal DS output from the data driving part 240 to the data line DL during the first sub-frame period SF1 may correspond to a white grayscale. Alternatively, the data voltage of the data signal DS output from the data driving part 240 to the data line DL during the first sub-frame period SF1 may correspond to a grayscale adjacent to a white grayscale.

The gate driving part 230 outputs the gate signal GS having the first gate on voltage VGON1 to the gate line GL of the display panel 210 during the first sub-frame period SF1 (S220). The gate driving part 230 selects the first gate on voltage VGON1 among the first gate on voltage VGON1, the second gate on voltage VGON2 and the third gate on voltage VGON3 received from the voltage supplying part 260, in response to the selection signal SEL indicating the first sub-frame period SF1, and outputs the first gate on voltage VGON1 as the gate signal GS. Here, the first gate on voltage VGON1 may correspond to the high voltage HIGH.

The data driving part 240 outputs the data signal DS to the data line DL of the display panel 210 during the second sub-frame period SF2 subsequent to the first sub-frame period SF1 in the frame period FRAME (S230). The data voltage of the data signal DS output from the data driving part 240 to the data line DL during the second sub-frame period SF2 is substantially identical to the data voltage of the data signal DS output from the data driving part 240 to the data line DL during the first sub-frame period SF1. Thus, the data voltage of the data signal DS output from the data driving part 240 to the data line DL during the second sub-frame period SF2 may correspond to a white grayscale. Alternatively, the data voltage of the data signal DS output from the data driving part 240 to the data line DL during the second sub-frame period SF2 may correspond to a grayscale adjacent to a white grayscale.

The gate driving part 230 outputs the gate signal GS having the second gate on voltage VGON2 to the gate line GL of the display panel 210 during the second sub-frame period SF2 (S240). The gate driving part 230 selects the second gate on voltage VGON2 among the first gate on voltage VGON1, the second gate on voltage VGON2 and the third gate on voltage VGON3 received from the voltage supplying part 260, in response to the selection signal SEL indicating the second sub-frame period SF2, and outputs the second gate on voltage VGON2 as the gate signal GS. Here, the second gate on voltage VGON2 may correspond to the middle voltage MIDDLE. Thus, the second gate on voltage VGON2 may be lower than the first gate on voltage VGON1.

The data driving part 240 outputs the data signal DS to the data line DL of the display panel 210 during the third sub-frame period SF3 subsequent to the second sub-frame period SF2 in the frame period FRAME (S250). The data voltage of the data signal DS output from the data driving part 240 to the data line DL during the third sub-frame period SF3 is substantially identical to each of the data voltage of the data signal DS output during the first sub-frame period SF1 and the data voltage of the data signal DS output during the second sub-frame period SF2. Thus, the data voltage of the data signal DS output from the data driving part 240 to the data line DL during the third sub-frame period SF3 may correspond to a white grayscale. Alternatively, the data voltage of the data signal DS output from the data driving part 240 to the data line DL during the third sub-frame period SF3 may correspond to a grayscale adjacent to a white grayscale.

The gate driving part 230 outputs the gate signal GS having the third gate on voltage VGON3 to the gate line GL of the display panel 210 during the third sub-frame period SF3 (S260). The gate driving part 230 selects the third gate on voltage VGON3 in response to the selection signal SEL indicating the third sub-frame period SF3, and outputs the third gate on voltage VGON3 as the gate signal GS. The third gate voltage is selected from among the first gate on voltage VGON1, the second gate on voltage VGON2 and the third gate on voltage VGON3 received from the voltage supplying part 260. Here, the third gate on voltage VGON3 may correspond to the low voltage LOW. Thus, the third gate on voltage VGON3 may be lower than the second gate on voltage VGON2.

In an exemplary embodiment the gate signal GS having the first gate on voltage VGON1 is applied to the gate line GL during the first sub-frame period SF1. The gate signal GS having the second gate on voltage VGON2 lower than the first gate on voltage VGON1 is applied to the gate line GL during the second sub-frame period SF2. The gate signal GS having the third gate on voltage VGON3 lower than the second gate on voltage VGON2 is applied to the gate line GL during the third sub-frame period SF3. In the current exemplary embodiment the data signal DS having substantially the same data voltage is applied to the data line DL during the first sub-frame period SF1, the second sub-frame period SF2 and the third sub-frame period SF3. The charge voltage CV charged in the pixel electrode 123 of the display panel 210 during the third sub-frame period SF3 is lower than the charge voltage CV charged in the pixel electrode 123 during the second sub-frame period, and the charge voltage CV charged in the pixel electrode 123 during the second sub-frame period SF2 is lower than the charge voltage CV charged in the pixel electrode 123 during the first sub-frame period SF1. The charge voltage CV charged in the pixel electrode 123 during the first sub-frame period SF1 may correspond to the high voltage HIGH according to the first gamma curve. The charge voltage CV charged in the pixel electrode 123 during the second sub-frame period SF2 may correspond to the middle voltage MIDDLE according to the second gamma curve. The charge voltage CV charged in the pixel electrode 123 during the third sub-frame period SF3 may correspond to the low voltage LOW.

In the present exemplary embodiment, the frame period FRAME includes three sub frame periods such as the first sub-frame period SF1, the second sub-frame period SF2 and the third sub-frame period SF3. The frame period FRAME may have an N number of sub-frame periods where N is a natural number. For example, the frame period FRAME may be divided into N sub-frames. The gate driving part 230 outputs, to the gate line GL, the gate signal GS having three gate on voltages such as the first gate on voltage VGON1, the second gate on voltage VGON2 and the third gate on voltage VGON3, but the present invention is not limited thereto. For example, the gate driving part 230 may output a gate signal having N different gate on voltages to the gate line GL during the N sub-frame periods.

According to the present exemplary embodiment, since the charge voltage CV corresponding to the high voltage HIGH is charged in the pixel electrode 123 during the first sub-frame period SF1 of the frame period FRAME. The charge voltage CV corresponding to the middle voltage MIDDLE is charged in the pixel electrode 123 during the second sub-frame period SF2 of the frame period FRAME. The charge voltage CV corresponding to the low voltage LOW is charged in the pixel electrode 123 during the third sub-frame period SF3 of the frame period FRAME. In the present exemplary embodiment the viewing angle of the display apparatus 200 may be increased compared to a case in which only a voltage corresponding to the high voltage HIGH is charged in the pixel electrode 123. Thus, display quality of the display apparatus 200 may be improved.

An exemplary embodiment of the invention discloses a display panel driving apparatus, a method of driving a display panel using the display panel driving apparatus, and a display device including the display panel driving apparatus having the ability to increase the viewing angle of a display apparatus. Thus, the display quality of the display apparatus may be improved.

The foregoing is illustrative of the present inventive concept and is not to be construed as limiting thereof. Although a few exemplary embodiments of the present inventive concept have been described, those skilled in the art will readily appreciate that many modifications are possible in the exemplary embodiments without materially departing from the novel teachings of the present inventive concept. Accordingly, all such modifications are intended to be included within the scope of the present inventive concept as defined in the claims.

What is claimed is:

1. A display panel driving apparatus comprising:

a data driving part configured to convert image data into a data signal and output the data signal to a data line of a display panel; and a gate driving part configured to output, to a gate line of the display panel, a gate signal having different gate on voltages during N sub-frame periods of a frame period including a first sub-frame period of the frame period and a second sub frame period subsequent to the first sub-frame period and a third sub-frame period subsequent to the second sub-frame period, wherein the data signal is output to the data lines during a plurality of the N sub-frame periods of the frame;

wherein the gate driving part outputs a first gate signal having a first gate on voltage during the first sub-frame period, outputs a second gate signal having a second gate on voltage lower than the first gate on voltage during the second sub-frame period, and outputs a third gate signal having a third gate on voltage lower than the second gate on voltage during the third sub-frame period and a data voltage of the data signal output from the data driving part is substantially the same during at least the first sub-frame period, the second sub-frame period, and the third sub-frame period of the N sub-frame periods, wherein N is a natural number.

2. A display panel driving apparatus comprising:

a data driving part configured to convert image data into a data signal and output the data signal to a data line of a display panel; and a gate driving part configured to output, to a gate line of the display panel, a gate signal having different gate on voltages during a first sub-frame period of a frame period and a second sub-frame period subsequent to the first sub-frame period, wherein a data voltage of the data signal output from the data driving part to the data line during the first sub-frame period and a data voltage of the data signal output from the data driving part to the data line during the second sub-frame period are the same, and wherein a charge voltage charged in a pixel electrode of the display panel during the second sub-frame period is different than a charge voltage charged in the pixel electrode during the first sub-frame period.

3. The display panel driving apparatus of claim 2, wherein each of the data voltage of the data signal output from the data driving part to the data line during the first sub-frame period and the data voltage of the data signal output from the data driving part to the data line during the second sub-frame period correspond to a white grayscale.

4. The display panel driving apparatus of claim 2, wherein the charge voltage charged in the pixel electrode of the display panel during the second sub-frame period is lower than the charge voltage charged in the pixel electrode during the first sub-frame period.

5. The display panel driving apparatus of claim 1, further comprising:

a voltage supplying part configured to supply the first gate on voltage, the second gate on voltage and the third gate on voltage to the gate driving part.

6. The display panel driving apparatus of claim 5, wherein the gate driving part comprises a voltage selecting part selecting one of the first gate on voltage, the second gate on voltage and the third gate on voltage in response to a selection signal indicating the first sub-frame period and the second sub-frame period.

7. A display panel driving apparatus comprising:

a data driving part configured to convert image data into a data signal and output the data signal to a data line of a display panel; and a gate driving part configured to output, to a gate line of the display panel, a gate signal having different gate on voltages during a first sub-frame period of a frame period and a second sub-frame period subsequent to the first sub-frame period, wherein the frame period further includes a third sub-frame period subsequent to the second sub-frame period, and wherein a data voltage of the data signal output from the data driving part to the data line during the first sub-frame period, a data voltage of the data signal output from the data driving part to the data line during the second sub-frame period, and a data voltage of the data signal output from the data driving part to the data line during the third sub-frame period are the same, and wherein a charge voltage charged in a pixel electrode of the display panel during the second sub-frame period is different than a charge voltage charged in the pixel electrode during the first sub-frame period and a charge voltage in the pixel electrode during the third sub-frame period.

8. The display panel driving apparatus of claim 7, wherein each of the data voltage of the data signal output from the data driving part to the data line during the first sub-frame period, the data voltage of the data signal output from the data driving part to the data line during the second sub-frame period, and the data voltage of the data signal output from the data driving part to the data line during the third sub-frame period correspond to a white grayscale.

9. The display panel driving apparatus of claim 7, wherein the charge voltage charged in the pixel electrode of the display panel during the second sub-frame period is lower than the charge voltage charged in the pixel electrode during the first sub-frame period, and a charge voltage charged in the pixel electrode of the display panel during the third sub-frame period is lower than the charge voltage charged in the pixel electrode during the second sub-frame period.

10. The display panel driving apparatus of claim 7, further comprising:

a voltage supplying part configured to supply a first gate on voltage, a second gate on voltage and a third gate on voltage to the gate driving part.

11. The display panel driving apparatus of claim 10, wherein the gate driving part comprises a voltage selecting part selecting one of the first gate on voltage, the second gate on voltage and the third gate on voltage in response to a selection signal indicating the first sub-frame period, the second sub-frame period and the third sub-frame period.

12. The display panel driving apparatus of claim 1, wherein the gate driving part outputs a gate signal including N different gate on voltages during the N sub-frame periods.

13. A method of driving a display panel, the method comprising:

outputting a data signal to a data line of the display panel during a first sub-frame period of a frame period;

outputting a gate signal having a first gate on voltage to a gate line of the display panel during the first sub-frame period;

outputting the data signal to the data line during a second sub-frame period subsequent to the first sub-frame period; and outputting a gate signal having a second gate on voltage different from the first gate on voltage to the gate line during the second sub-frame period, wherein the data signal is output to the data line during both the first sub-frame period and the second sub-frame period, and wherein a data voltage of the data signal output to the data line during both the first sub-frame period and the second sub-frame period is substantially the same, and wherein a charge voltage in a pixel electrode of the display panel during the second sub-frame period is different than a charge voltage charged in the pixel electrode during the first sub-frame period.

14. The method of claim 13, wherein the second gate on voltage is lower than the first gate on voltage, and the charge voltage charged in the pixel electrode of the display panel during the second sub-frame period is lower than the charge voltage charged in the pixel electrode during the first sub-frame period.

15. The method of claim 14, further comprising:

outputting the data signal to the data line during a third sub-frame period subsequent to the second sub-frame period; and outputting a gate signal having a third gate on voltage different from the first gate on voltage and the second gate on voltage to the gate line during the third sub-frame period.

16. The method of claim 15, wherein the third gate on voltage is lower than the second gate on voltage, and a charge voltage charged in the pixel electrode of the display panel during the third sub-frame period is lower than the charge voltage charged in the pixel electrode during the second sub-frame period.

17. A display apparatus comprising:

a display panel configured to display an image and including a gate line and a data line;

a display panel driving apparatus comprising a data driving part configured to convert image data into a data signal and output the data signal to the data line, and a gate driving part configured to output, to the gate line, a gate signal having different gate on voltages during a first sub-frame period of a frame period and a second sub-frame period subsequent to the first sub-frame period, and wherein a data voltage of the data signal output from the data driving part is substantially the same during at least the first sub-frame period, and the second sub-frame period, and is output to the data line during both the first sub-frame period and the second sub-frame period, and wherein a charge voltage charged in a pixel electrode of the display panel during the second sub-frame period is different than a charge voltage charged in the pixel electrode during the first sub-frame period.

18. The display apparatus of claim 17, wherein the frame period includes N (N is a natural number) sub-frame periods, and the gate driving part outputs a gate signal having N different gate on voltages during N sub-frame periods.

* * * * *